US006116453A

United States Patent [19]

Przytulla

[11] Patent Number: 6,116,453

[45] Date of Patent: Sep. 12, 2000

[54] LIDDED BARREL

[75] Inventor: Dietmar Przytulla, Kerpen, Germany

[73] Assignee: Mauser-Werke GmbH, Germany

[21] Appl. No.: 09/363,017

[22] Filed: Jul. 29, 1999

Related U.S. Application Data

[63] Continuation of application No. 08/793,751, Jun. 11, 1997, Pat. No. 5,964,367, which is a continuation-in-part of application No. 08/283,695, Aug. 1, 1994, Pat. No. 5,593,060, which is a continuation of application No. 08/049,722, Apr. 20, 1993, abandoned.

[30] Foreign Application Priority Data

| | | | |
|---|---|---|---|
| Oct. 28, 1992 | [DE] | Germany | 42 36 338 U |
| Sep. 15, 1994 | [DE] | Germany | 94 14 955 U |
| Nov. 3, 1994 | [DE] | Germany | 94 17 442 U |

[51] Int. Cl.[7] ..... B65D 45/32

[52] U.S. Cl. ..... 220/319

[58] Field of Search ..... 220/319, 320, 220/321, 630, 634, 640, 649, 675, 610, 614, 615, 616, 617, 622, 623, 254, 601

[56] References Cited

U.S. PATENT DOCUMENTS

| | | |
|---|---|---|
| 2,989,208 | 6/1961 | Gibbs, Jr. . |
| 3,443,735 | 5/1969 | Meijers . |
| 3,515,306 | 6/1970 | Roper . |
| 3,516,571 | 6/1970 | Roper et al. . |
| 3,531,013 | 9/1970 | Hammes . |
| 3,664,544 | 5/1972 | Hammes . |
| 3,696,962 | 10/1972 | Fehres et al. . |
| 3,817,420 | 6/1974 | Heisler . |
| 3,868,041 | 2/1975 | Knize . |
| 3,955,705 | 5/1976 | Dubois et al. . |
| 4,111,330 | 9/1978 | Jordan . |
| 4,117,062 | 9/1978 | Uhlig . |
| 4,171,062 | 10/1979 | Allen et al. . |
| 4,177,934 | 12/1979 | Hammes et al. . |
| 4,321,922 | 3/1982 | Deaton . |

(List continued on next page.)

FOREIGN PATENT DOCUMENTS

| | | |
|---|---|---|
| 366129 | 5/1990 | European Pat. Off. . |
| 504650 | 9/1992 | European Pat. Off. . |
| 784 020 A1 | 1/1997 | European Pat. Off. . |
| 2017380 | 5/1970 | France . |
| 8631318 | 1/1987 | Germany . |
| 40 41 784 | 8/1991 | Germany . |
| 41 26 784 | 2/1993 | Germany . |
| 2 201 191 | 7/1993 | Germany . |
| 42 20 339 | 1/1994 | Germany . |
| 42 36 338 | 5/1994 | Germany . |
| 61-93038 | 5/1986 | Japan . |
| 679 770 | 4/1992 | Switzerland . |
| 1 225 625 | 3/1971 | United Kingdom . |
| 1 275 949 | 6/1972 | United Kingdom . |
| 1 426 530 | 3/1976 | United Kingdom . |
| WO 9112178 | 8/1991 | WIPO . |

OTHER PUBLICATIONS

Product Reference Guide IPCC International Precision Components Corporation (15 pages).

Mauser–Werke drawing Am–2553 dated Feb. 22, 1991 of prior art CCA drum and lid.

Wavin–Brochure (2 pages).

*Primary Examiner*—Stephen Castellano

*Attorney, Agent, or Firm*—Pennie & Edmonds LLP

[57] ABSTRACT

This invention relates to a cylindrical, blow-molded lidded barrel (wide-mouthed drum) with a barrel lid and tension-ring closure. Previously known lidded barrels have comparatively little ability to withstand falls and are therefore not well-suited for handling liquids. Owing to the special configuration of the barrel lid and the barrel mouth edges as well as by a special matching of the individual components to one another, the lidded barrel according to the invention can be manipulated in the filled state with the same barrel-gripping tool (parrot's beak), ans is universally employed and in industrial use for modem plastic L-ring bung barrels or normal steel bung barrels. By improving the strength of the lidded barrel when it is dropped, the barrel is also made especially well-suited for handling liquids since it remains liquidtight even when dumped or dropped from great heights.

28 Claims, 10 Drawing Sheets

U.S. PATENT DOCUMENTS

| | | | |
|---|---|---|---|
| 4,379,455 | 4/1983 | Deaton . | |
| 4,500,010 | 2/1985 | Schutz . | |
| 4,518,097 | 5/1985 | Milton et al. . | |
| 4,674,650 | 6/1987 | Hamilton et al. . | |
| 4,776,479 | 10/1988 | Schutz . | |
| 4,779,754 | 10/1988 | Eytck et al. . | |
| 5,033,639 | 7/1991 | Przytulla . | |
| 5,190,157 | 3/1993 | Przytulla . | |
| 5,207,345 | 5/1993 | Stewart et al. . | |
| 5,225,125 | 7/1993 | Wildfeuer et al. . | |
| 5,301,853 | 4/1994 | Addison et al. . | |
| 5,427,264 | 6/1995 | Addison . | |
| 5,445,293 | 8/1995 | Schutz . | |
| 5,593,060 | 1/1997 | Przytulla . | |
| 5,605,244 | 2/1997 | Bradshaw | 220/320 |
| 5,785,201 | 7/1998 | Bordner et al. | 220/321 |
| 5,823,340 | 10/1998 | Maihofer | 206/370 |
| 5,881,898 | 3/1999 | Irwin et al. | 220/319 |
| 5,964,367 | 10/1999 | Przytulla | 220/319 |

LIDDED BARREL

RELATED APPLICATIONS

This is a continuation application of U.S. application Ser. No. 08/793,751 filed Jun. 11, 1997, now U.S. Pat. No. 5,964,367, which is a continuation-in-part of U.S. application Ser. No. 08/283,695 filed Aug. 1, 1994, now U.S. Pat. No. 5,593,060, which is a continuation application of U.S. application Ser. No. 08/049,722, filed Apr. 20, 1993, now abandoned.

BACKGROUND OF THE INVENTION

This invention relates to a cylindrical, blow-molded lidded barrel=wide-mouthed drum with a barrel lid and tension-ring closure, in which in the closed position, the tension ring, which is U-shaped in cross section, engages with its upper leg over the outside upper edge of the lid and engages with its lower leg under an outside edge of the barrel that runs basically horizontally or slightly obliquely downward in the opening area of the body of the barrel.

Such a lidded barrel is known from, e.g., DE-B-41 08 606. In the case of this barrel, however, the tension-ring closure is arranged some distance below the upper edge of the lid or the opening of the barrel, so that handling such a filled, e.g., 220-liter lidded barrel with a shipping weight of about 230 kg is possible only using special barrel-gripping tools. This type of a lidded barrel was developed by Mauser in 1975 and distributed worldwide under the designation "standard lidded barrel"; it is well-suited for handling solid, particulate or pasty contents, but such a barrel is not readily suited for use with liquids.

In the case of lidded barrels, the sealing action of the barrel lid on the barrel mouth is produced by bringing about axial prestressing on the lid seal via the tension ring leg bevels at the upper edge of the lid and at the outer border of the barrel body (or indentation) as the tension ring is clamped or closed.

On lidded barrels that are approved for use in, e.g., the chemical industry, certain requirements with respect to their storage and transport safety are set; compliance with these requirements is tested and examined in special acceptance tests (e.g., dropping on its side=jacket dropping, diagonal dropping on the edge of the lid, static internal pressure test, i.a.). In the case of known existing plastic lidded barrels, even when barrels are dropped from heights of about 1.20 m—e.g., from the bed of a truck—leaks occur, especially in the case of liquids, or complete detachment of the barrel lid can even occur.

The drawbacks of previously known lidded barrels consist of, especially, a) when there is axial internal pressure on the barrel lid (surge pressure when a barrel filled with water is dropped on its jacket or when there is hydraulic internal pressure in a closed barrel), b) when a closed barrel that is filled with water slams flat against a side wall (jacket dropping), and c) when a closed barrel that is filled with water drops diagonally onto the edge of the lid, various reactions occur:

the barrel lid is pressed axially outward, the tension ring is pulled axially outward, the tension ring (together with lid and barrel mouth area) is flattened at the central impact point, the tension ring is heavily buckled laterally at the impact point and its U-shape is flared at both buckling points, the lid edge tries to slide out from under the upper tension ring leg, prestressing on the seal is reduced and the locking system begins leaking.

The stresses that occur with the deformations must be absorbed in each case by the U-shaped tension ring. In this connection, the legs are pressed outward (flared) in the buckling areas. If the stress on the legs is too high, it leads to permanent deformations, prestressing on the seal is reduced at those points, and significant flaring results in leaks or leaking of the barrel.

An attempt is thus to be made to reduce the deformation of the tension ring, especially the flaring in the U-area, by structural measures, especially in the barrel mouth area, at the barrel lid and/or tension ring, while at the same time continuing to ensure good handling, i.e., easy closing of the tension ring.

SUMMARY OF THE INVENTION

The object of this invention is to indicate a lidded barrel made of plastic with a barrel lid and tension-ring closure which, owing to the special way in which the individual components are matched to one another, makes it possible to use the same barrel-gripping tool (parrot's beak) or which, in the filled state, can be manipulated with the same barrel-gripping tool, as usually used universally for modern plastic L-ring bung barrels or normal steel-bung barrels. In this case, the lidded barrel is to be especially suitable for using liquids, i.e., it remains liquidtight even when it falls or is dropped from considerable heights.

This object is achieved according to the invention in that directly behind the outer lid edge, which is overlapped by the upper leg of the tension-ring closure and which is shaped in cross section like a downward-facing U, in which the lid seal is inserted or foamed-in, the barrel lid has an essentially V-shaped engaging groove which has a flat groove floor and which is drawn in peripherally downward into the barrel body, between a reduced-diameter central lid disk and the lid edge, the inside boundary of the engaging groove is formed by a ring part which slopes conically upward and to which is connected the flat lid disk with at least one bunghole that is recessed laterally in a bung housing, the lower leg of the tension-spring closure engages tightly below (about 15 mm) the upper barrel edge in an indentation in the upper barrel wall, whose upper boundary represents the essentially horizontal barrel edge or slightly oblique attachment surface for the tension ring and whose outline, as it moves downward toward the transition to the fully cylindrical part of the barrel wall, is essentially designed to be increasingly flat-conical, and the transition from the conical area to the fully cylindrical part of the barrel body is arranged at a distance of 80 mm to 140 mm, preferably about 120 mm, from the upper front edge of the barrel mouth edge, and the upper barrel edge of the barrel mouth is designed solidly as an outer support for a lid seal and has a width (thickness) of approximately double the wall thickness of the barrel body.

This special design of the upper outer area of the lidded barrel according to the invention makes it possible, on the one hand, to use or apply barrel-gripping tools that are generally employed for bung barrels; on the other hand, the lidded barrel according to the invention also has considerably improved liquid sealing properties in the case where it is filled with liquid, e.g., in the case where barrels are dropped from considerable heights (about 1.8 m) or in the case of the previously described acceptance tests.

In a variant embodiment of the invention, it is provided that the conical outline of the barrel wall inside the indentation below the horizontal attachment surface for the lower leg of the tension-ring closure be made at an acute angle of between 15° and 30°, preferably about 18° to 20°, at the transition in the fully cylindrical part of the barrel body to the longitudinal axis of the barrel. As a result, the barrel-gripping device can, as usual, be brought in first against the cylindrical barrel body in the usual way and then raised upward, passing into the indentation until the lower barrel-gripping claw strikes the lower leg of the tension ring which rests on the horizontal attachment surface of the edge of the barrel and the upper barrel-gripping claw automatically pivots inward and tilts owing to the resistance that is produced, and the lidded barrel is tightly grasped and can be transported.

To ensure a secure fit of the lower tension-ring leg as well as the barrel-gripping claw that is applied thereto, it is provided according to the invention that the radial depth of the indentation, measured by the extension line of the fully cylindrical part of the barrel body, be between 12 mm and 25 mm, preferably about 17 mm. In this case, the slightly oblique barrel edge, which is used as attachment surface for the lower leg of the tension ring and which simultaneously represents the upper boundary of the indentation, is made at a distance of about 10 to 20 mm, preferably about 15 mm, from the upper barrel edge in the outside wall of the barrel body. A solid outer support for the tension ring and for the barrel-gripping device that is put on is further achieved in that the solid barrel mouth edge, with its upward-pointing smooth area that has the shape of a partial circle and is used as a sealing surface for the lid seal, is produced during the blow-molding process by squeezing the thermoplastically deformable plastic of the barrel wall with the aid of a mold slide, and outside on the solid barrel edge, a peripherally smaller flange edge with a radial extension of about 3 to 5 mm is formed, thus increasing the width of the horizontal support surface for the lower leg of the tension ring.

Since the lidded barrel according to the invention in its light design for a capacity of 35 US gallons has a barrel (body) weight of only about 5.2 kg and for a capacity of 55 US gallons has a barrel (body) weight of only about 8.2 kg, as well as an opening width of the upper barrel mouth that is about 15% larger than a usual bulgy lidded barrel of the above-mentioned type, it is very well suited for granulate-like or pasty contents, for which mainly fiber drums are now used.

In the USA, fiber drums, optionally with liners, are also widely used for liquids. Because of its excellent gas and liquid sealing properties as well as the ability to drain residue almost completely (with the lid on) via the residue-drain lid bung, the lightweight lidded barrel according to the invention is also highly suitable for using liquids instead of the previously usual fiber drums.

Other advantages of the lidded barrel according to the invention consist in the fact that it has dimensions that are identical to the greatest ex-tent possible to those of a corresponding plastic L-ring bung barrel or steel bung barrel, and it can thus be handled with the same barrel-gripping tools (parrot's beak). These lidded barrels can also be handled on pallets together with bung barrels without the losses of space due to big-bellied lidded barrels and differing heights that otherwise usually occur. The filling of the lidded barrels is done via the 2-inch bung using the same filling systems as for bung barrels since the dimensions and arrangements of the lid bung correspond exactly to the relevant dimensions of the bung barrel.

Reconditioning of the lidded barrels for reuse or multiple use is considerably simpler and more efficient in comparison with bung barrels, and also later disposal causes no problems whatsoever since the plastic of the barrel body and barrel lid as well as the tension ring, whether it is made of steel or of plastic, can be recycled without residue.

BRIEF DESCRIPTION OF THE DRAWINGS

The invention as well as other advantageous embodiment variants are explained in greater detail and described below based on the embodiments diagrammatically presented in the drawings. Here.

DETAILED DESCRIPTION OF THE INVENTION

Figure 1:
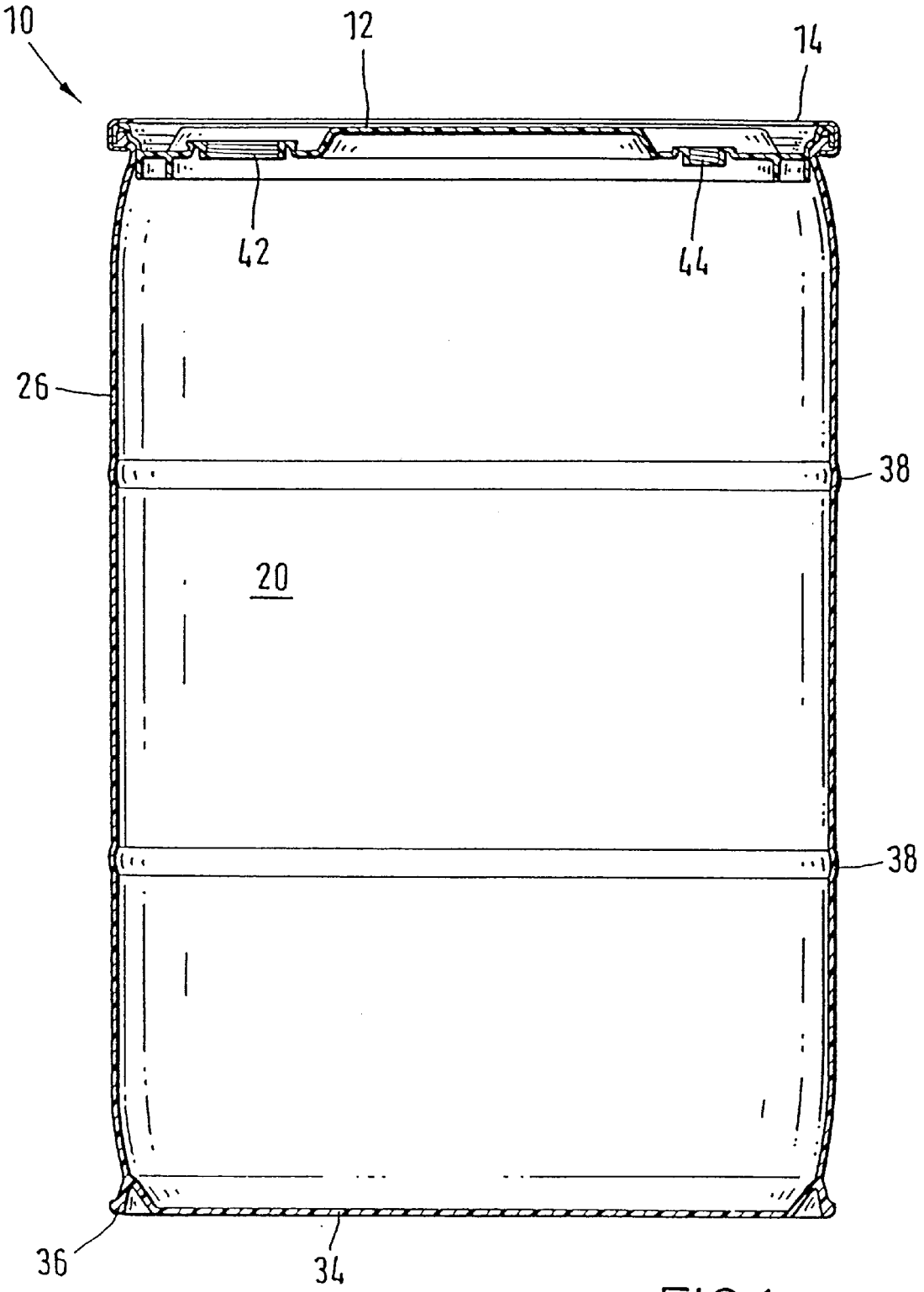
FIG. 1 shows a lidded barrel with a base ring according to the invention, in side view.

In FIG. 1, a lidded barrel with a capacity of 55 US gallons here, according to the invention, which is provided with a barrel lid 12 put on and a tension-ring closure 14 in place, is referred to by reference number 10. About 80% of barrel body 20 is designed as fully cylindrical, while about 10% respectively of the barrel height upward toward barrel opening edge 28 and downward toward barrel bottom 34 is drawn in with a slight conical taper. In fully cylindrical part 26 of barrel body 20, two comparatively broad rounded barrel body roller cages 38 are arranged at one-third and two-thirds of the barrel height. In the conically tapered transition area between fully cylindrical part 26 of barrel body 20 and flat barrel bottom 34, a solid bottom roller cage 36 that ends flush with barrel bottom 34 is provided. Bottom roller cage 36 has a trapezoidal cross section below with a thinner bridge connection to barrel body 20 and an outside diameter that is almost identical to that of tension ring 14, which is put on in the closed state and imparts to lidded barrel 10 excellent stability, especially when several barrels are stacked on top of one another, and a high degree of stiffness or resistance to indentation or crushing (buckling work in plastic) of the lower barrel edge when a filled lidded barrel is rolled at an oblique angle.

The barrel with a capacity of 55 US gallons has a maximum diameter of about 578 mm and a height of about 898 mm (height/diameter ratio about 1.55). A first modified barrel design with identical diameter dimensions, but a somewhat smaller volume of 52.5 US gallons, has a height/diameter ratio of about 1.49, and the barrel height with a tension ring mounted is about 860 mm. This barrel thus is of precisely the same height as the usual lidded barrels that are found in the USA, and it can therefore be handled on a pallet with the latter. A second modified barrel design with identical diameter dimensions, but a comparatively smaller volume of only 36 US gallons, has a height/diameter ratio of only 1.06, and the barrel height with a tension ring mounted is about 610 mm. This barrel (the so-called "stubby drum") appears as high as it is wide and is provided especially for granulate-like or powder-like products, such as pigments, and to remove them from the barrel, the pigments are "scooped out" by hand with a scoop. Owing to the small height (about one arm's length) of the barrel, it is also possible to remove residue from the lower barrel area without having to bend double to reach into the barrel or to inhale dust particles.

Figure 2:
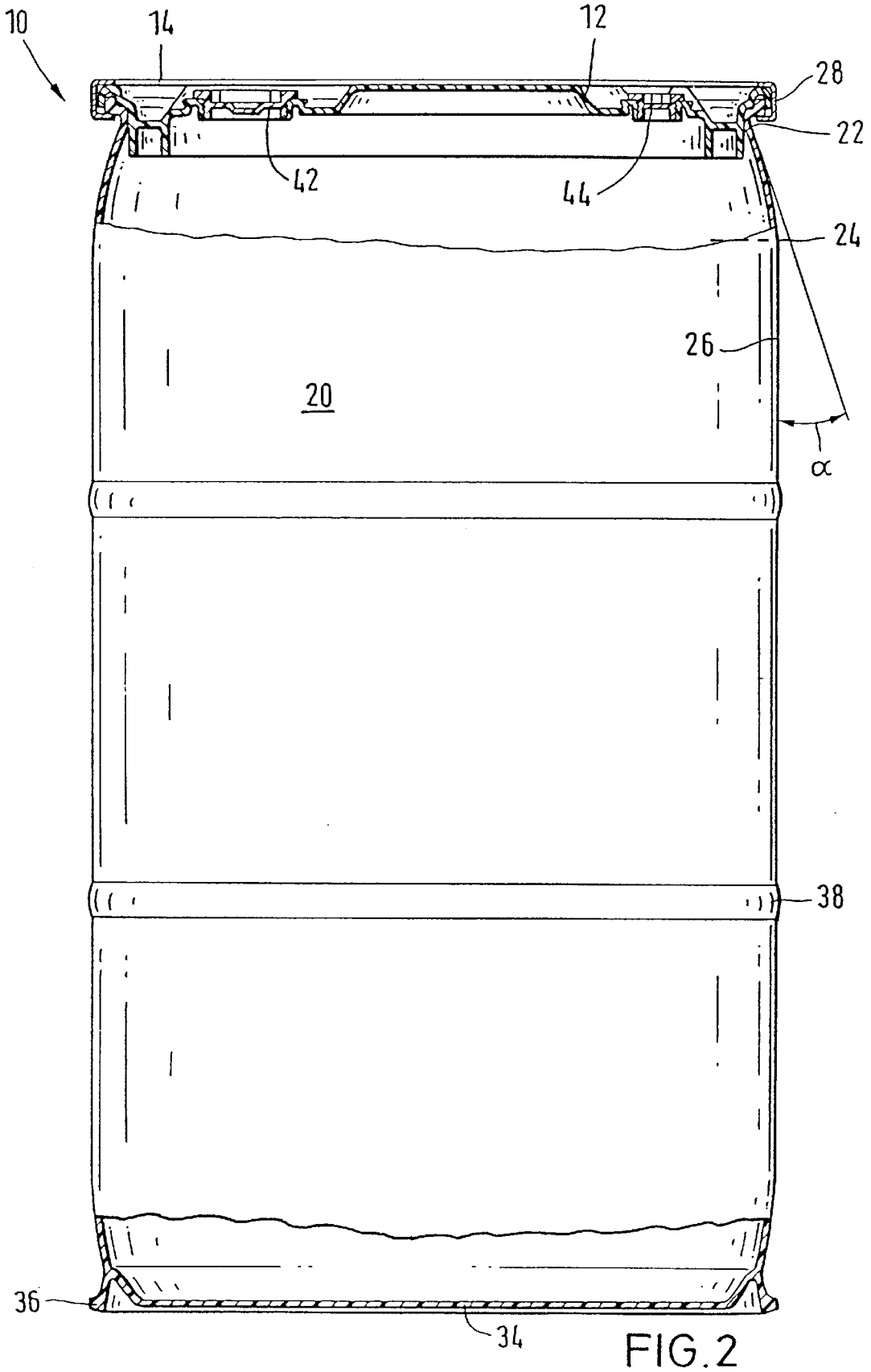
FIG. 2 shows another embodiment of the lidded barrel according to the invention.

In FIG. 2, a slender lidded barrel 10 with a volume of 35 US gallons is depicted as a preferred embodiment. This lidded barrel has a height of about 860 mm and a maximum diameter of barrel body roller cages 38 of about 475 mm. The height/diameter ratio of this barrel is about 1.82. A modified barrel design with the identical diameter dimensions, but a smaller volume of 30 US gallons has, on the other hand, a height-diameter ratio of about 1.57, and the barrel height with a tension ring mounted is about 745 mm. The two barrel types of identical diameter (according to FIGS. 1 and 2) with only different heights can be produced in an advantageous way in a single alternating blow mold. To this end, only a suitable extension ring piece in the blow mold needs to be used (taller barrel) or removed (shorter barrel).

The particular feature of this embodiment variant thus consists in the fact that it has almost the same dimensions as the fiber drums that are usually used today in the USA and can be manipulated and handled with the same barrel-gripping tools as the usual fiber drums or bung barrels. In addition, the novel lidded barrels in a light design can be produced more economically than comparable fiber drums and subsequently cause no disposal problems whatsoever since they are completely recyclable. The tension ring can be a usual sheet-steel closure ring, but it can also be made entirely of plastic.

When using the lidded barrel according to the invention to hold liquids, barrel lid 12 is equipped with at least one bung opening, preferably with two lateral bung openings that can be sealed and are arranged on opposite sides from one another; larger bung 42 has a 2-inch (about 50.8 mm) opening, and smaller bung 44 has a ¾-inch (about 19.1 mm) opening. From FIG. 2, it is also clear that the conical outline of the barrel wall inside indentation 22 below horizontal attachment surface 18 for the lower leg of tension-ring closure 14 is made at an acute angle a of between 15° and 30°, preferably about 18° to 20°, at transition 24 to fully cylindrical part 26 of barrel body 20. This configuration ensures a high degree of resistance to stacking stresses.

Figure 3:
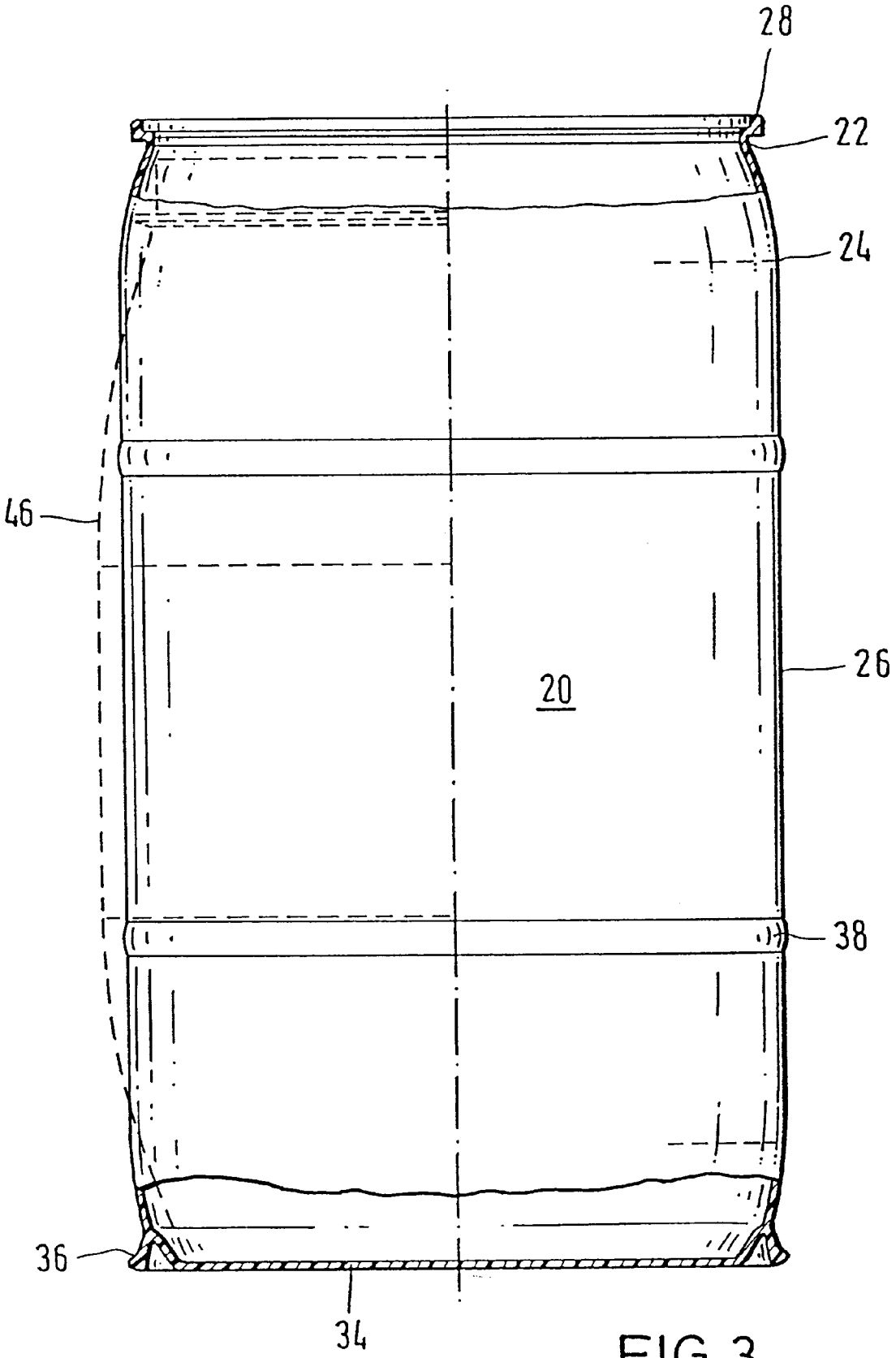
FIG. 3 shows a configuration comparison between a usual bulgy lidded barrel and a cylindrical lidded barrel according to the invention.

In FIG. 3, a previously commonly used bulgy standard lidded barrel or its barrel body 46 is drawn in the left half of the drawing in dotted configuration for comparison with barrel body 20 according to the invention. From this, the improved stability of the more slender lidded barrel according to the invention is clear. Furthermore, it is evident that in the case of the bulgy barrel body, the fully cylindrical part is only about one-third (⅓) of the entire height of the barrel body, while fully cylindrical part 26 in the case of the barrel body according to the invention constitutes more than three-fourths (¾) of the entire height of the barrel body. As an advantageous result, especially also due to sturdy bottom roller cage 36, the barrels can be more easily handled on pallets, while simultaneously having improved stability and better rolling-off capability when the barrel is tilted.

Figure 4:
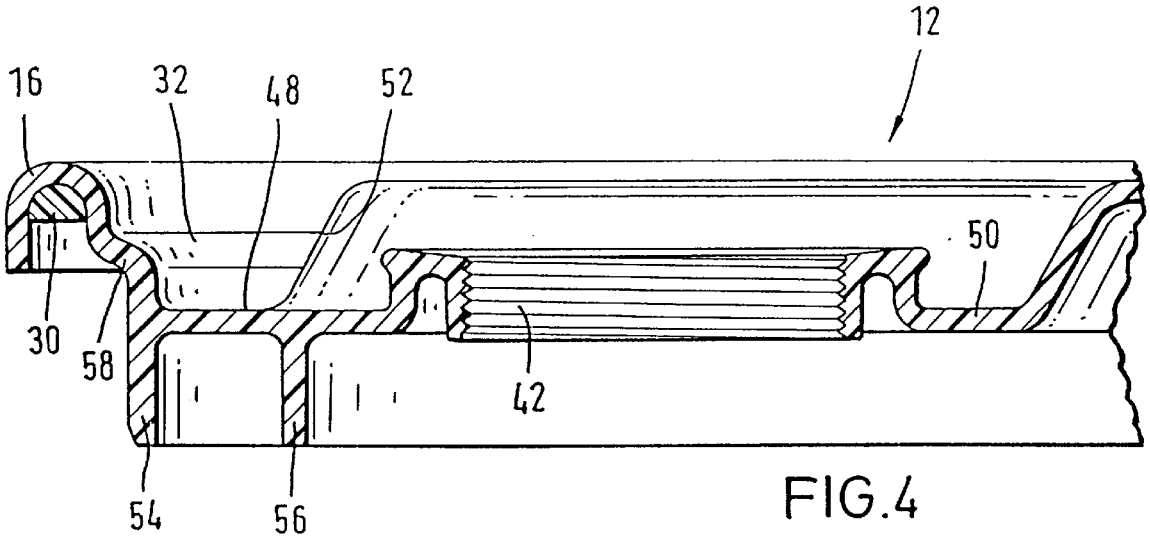
FIG. 4 shows a sectional view through the left edge area of a lidded barrel according to the invention (US version)

In FIG. 4, the left edge area of a lidded barrel 12 according to the invention is shown in cross-sectional view. A lid seal 30 is inserted or foamed-in into downward-facing U-shaped lid edge 16. An approximately 25 mm deep engaging groove 32 is made between lid edge 16 and central flat lid disk 80 that is arranged almost flush at the same height Engaging groove 32 has a flat groove floor 48, which evenly extends radially inward at least 10 mm, and preferably about 15 mm. An obliquely conical ring part 52 rises from groove floor 48 as a connecting piece to upper flat lid disk 80.

On the lower side of barrel lid 12, two approximately 20 mm long (axial) ring flanges 54, 56 that extend down below engaging groove 32 are made in the outside edge area. Ring flanges 54, 56 are about 20 mm apart and are used to increase the stiffness of barrel lid 12. Also visible is 2-inch bung 42 that is arranged in a sunken bung housing 50. Of special importance is an intermediate piece or connecting piece 58 which is formed between U-shaped lid edge 16 and groove floor 48 and which, starting from lid edge 16, is bent or angled inward. With barrel lid 12 put in place, this bent connecting piece 58 or outer axial ring piece 54 comes to rest with the inside wall of barrel body 20 opposite outer indentation 22 and increases the stacking capacity of the lid or lidded barrel because of the mutual support.

Figure 5:
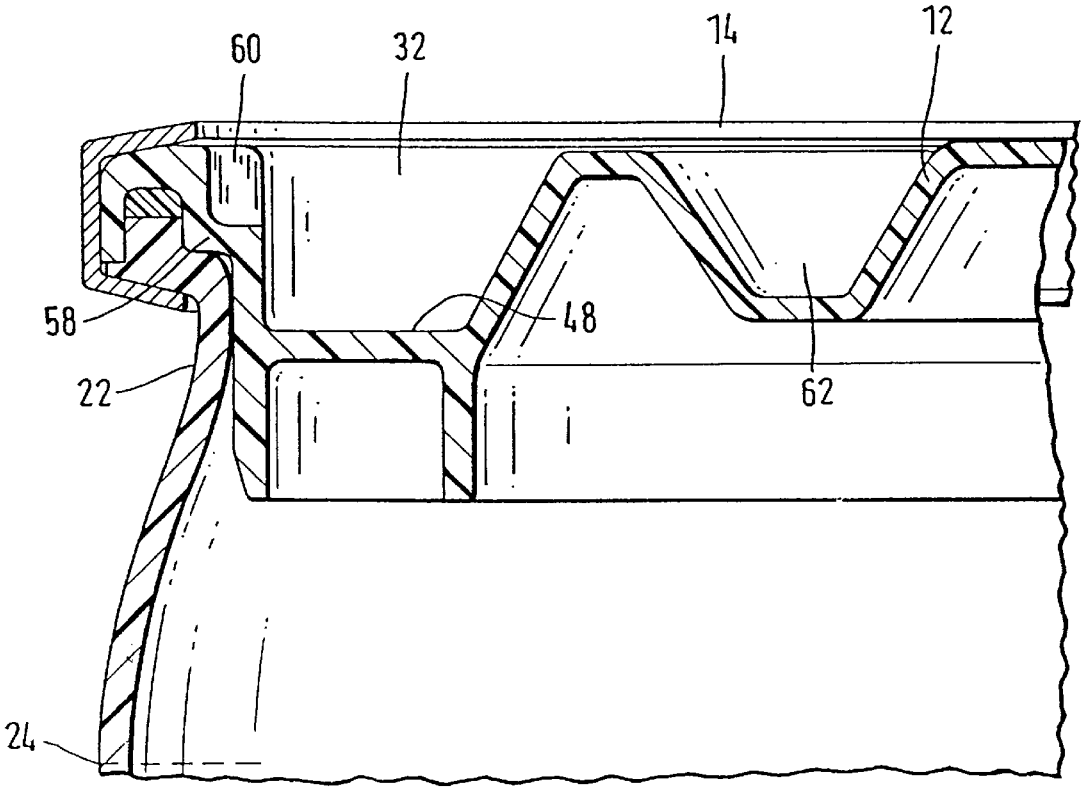
FIG. 5 shows a sectional view through the left upper edge area of a lidded barrel according to the invention.

In FIG. 5, a corresponding partial section through the left upper edge area of a barrel lid 12 according to the invention is shown, but laterally outside a bung or bung housing. Here, radial ribs 60 that rest on the inside against U-shaped lid edge 16 are arranged above angled connecting piece 58. Radial ribs 60 are provided in large numbers with a small lateral spacing of about 5 mm to 10 mm.

Furthermore, in this embodiment of barrel lid 12, a second upward-facing peripheral V-shaped groove 62 with a preferably rounded groove floor in the outside area of flat lid disk 80 is provided facing radially inward behind engaging groove 32. This groove 62 is interrupted only by the recessed bung housing and improves the elasticity of the lid against internal overpressure and the surge pressure that occurs when a barrel falls.

Figure 6:
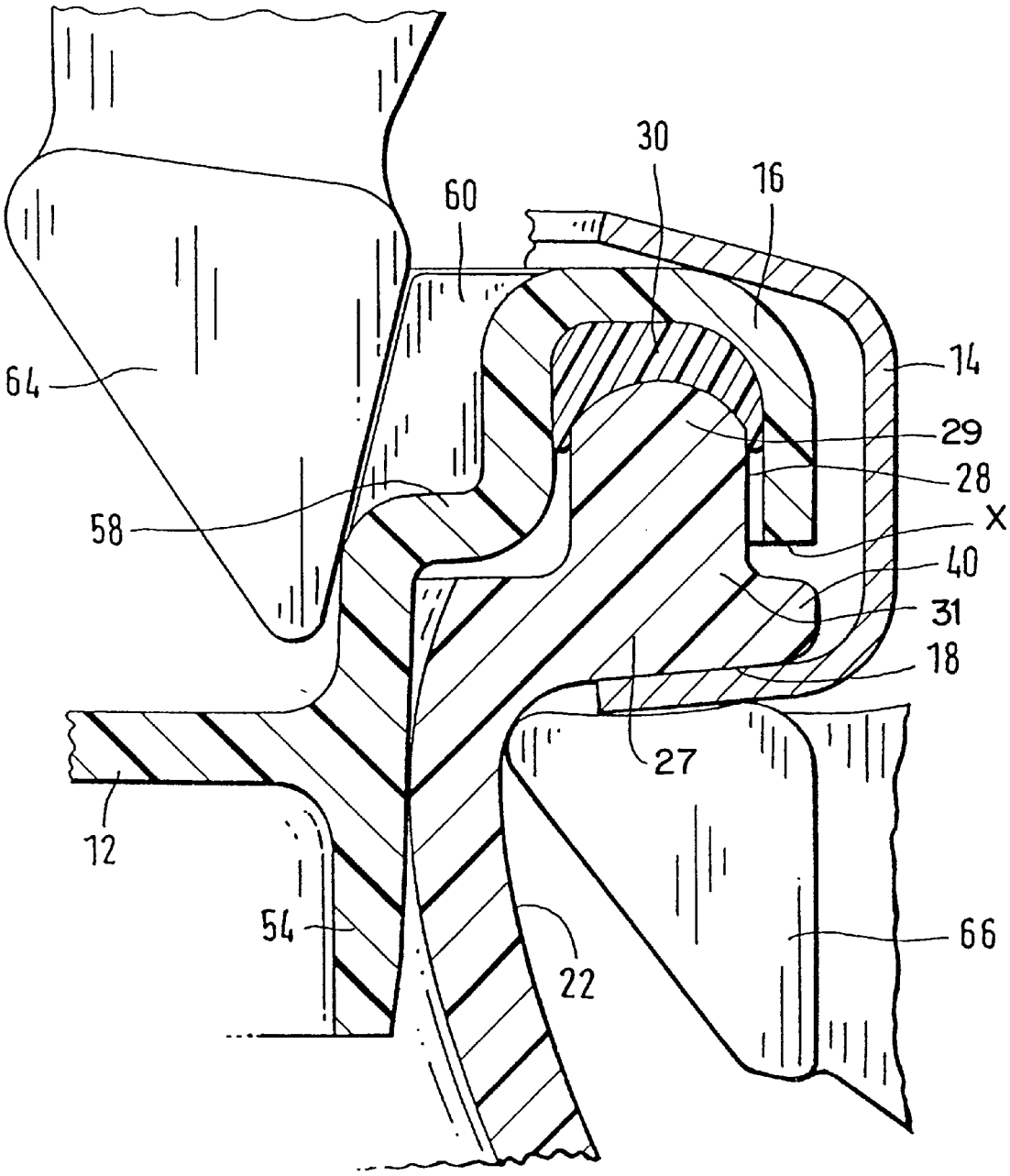
FIG. 6 shows a sectional view through the right upper edge area of a lidded barrel with barrel-gripping claws that are put on according to the invention.

Further, FIG. 6 shows the upper right edge area of a lidded barrel according to the invention with barrel-gripping claws 64, 66 applied. For the light barrel design, it is necessary that, in particular, the barrel lid and the barrel opening area be matched exactly to one another. Part of this is that, i.a, to ensure secure attachment of lower barrel-gripping claw 66, the radial depth of indentation 22—measured from the extension line of the fully cylindrical part of the barrel body—is between 12 mm and 25 mm, preferably about 17 mm. The width of the horizontal support surface for the lower leg of tension ring 14 or the attachment surface for barrel-gripping claw 66 is also increased by virtue of the fact that solid barrel opening edge 28 is produced during the blow-molding process by squeezing the thermoplastically deformable plastic of the barrel wall with the aid of a mold slide, so that a small peripheral flange edge 40 extending radially outward about 3 to 5 mm is formed on the outside at the bottom at barrel edge 28.

In FIG. 6, it is further evident that the area of solid barrel opening edge 28 that points upward with a height of about 8 mm upward has a smooth, partially circular cross section as a sealing surface for lid seal 30. A special design of the mold slide in the blow mold ensures that this sealing surface of squeezed solid barrel opening edge 28 that points upward and is exactly opposite lid seal 30 remains free of folds and seams of the squeezed plastic. These folds and seams are shifted outward and are advantageously arranged in outer flange edge 40, where they no longer pose a problem. To improve the engagement area of upper barrel-gripping claw 64, a considerable number of radial ribs 60 can be provided above bent connecting piece 58 behind U-shaped lid edge 16.

Figure 7:
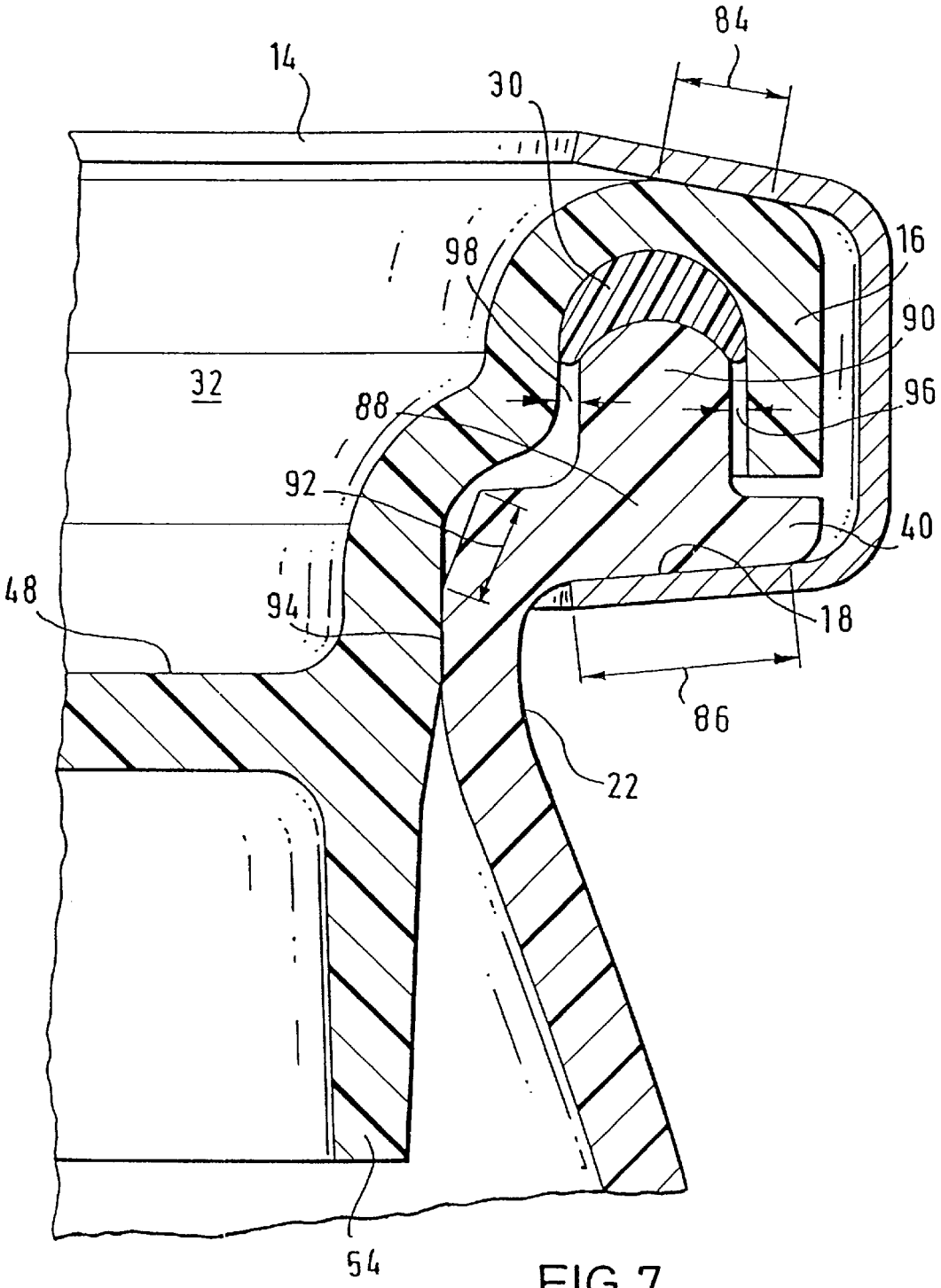
FIG. 7 shows an enlarged sectional view through the right upper edge area of a lidded barrel according to the invention.

To illustrate important features according to the invention, FIG. 7 shows once more in detailed representation the upper right barrel area of a lidded barrel. Quite important structural features consist especially in the fact that:

Above on the lid edge, an approximately 6 mm to 12 mm, preferably 8 mm wide, slightly obliquely adapted support surface 84 (identified by arrow) is formed for the upper leg of tension ring closure 14. Thus, when, for example, a barrel is dropped, the lid edge cannot move outward in the buckling areas under the tension ring, and the stress on the lid seal will not be relieved.

Because of flange edge 40 which projects or overhangs outward at the lower outside edge of the barrel body opening, an enlarged support surface 18 of at least 10 mm is provided for the lower slightly oblique leg of tension ring 14. The support surface is (in the radial direction) preferably even 15 mm (arrow 86) wide. This is also advantageous for reliably gripping the barrel with the lower claw of the barrel-gripping tool (parrot's beak). Groove floor 48 of outer peripheral engaging groove 32 is arranged at the same height as or even a little below the lower leg of tension ring 14. As a result, the upper claws of the barrel-gripping device engage far down into engaging groove 32 and reliably secure the lidded barrel.

The barrel body edge, which is overlapped by tension ring 14, is basically designed as a T that projects upward with a horizontal arm 88 and a vertical arm 90 that is arranged approximately in the center and pointing upward, and the surface of vertical arm 90 that is pointing upward is rounded in the shape of a partial circle (radius 4.5 mm) and represents the sealing surface of the barrel body edge that comes into contact with lid seal 30. A partial piece of horizontal arm 88 that points outward is represented by flange edge 40, which projects radially outward. The partial piece of the horizontal arm that points inward connects to the barrel body wall that runs downward. The cut point or cut surface of the cut-off slug piece (waste piece from the blow-molding process) is located in the transition area from the partial piece that points inward to the barrel wall that runs downward. The cut edge can run perpendicular or—as represented—slightly obliquely downward and toward the inside. Directly below the cut edge, there is a contact area 92 of the barrel inner wall with the outside surface of the barrel lid or the extension of outer lid ring arm 54. In contact area 92 is the narrowest diameter of the barrel body opening, which is about 2 to 4 mm smaller here than at the cut edge of the slug piece. When the cover is mounted, outer lid ring arm 54 passes into the barrel interior and radial centering and bracing of the lid on the inner wall of the barrel takes place in contact area 92 below the cut surface of the slug piece. If a number of barrel bodies are distorted in a slightly oval shape, e.g,. by shrinkage stresses, a centering adaptation is made in the barrel opening area, thus ensuring a uniform positioning and an exact fit of the sealing surface of upward-pointing vertical arm 90 to lid seal 30. Such centering cannot be achieved with conventional barrel lids, which do not project part-way into the barrel interior and make contact there with the barrel inner wall. It is just this kind of centering that makes it possible to adapt the width of vertical arm 90 (8 mm wide, about 9 mm high) to the inner width (about 10 mm) of the downward-facing U-shaped lid edge precisely enough to ensure that, on the outside and inside of vertical arm 90, exact lateral spacing gaps 96, 98 (identified by arrows) 1 mm wide are left. This ensures that vertical arm 90 with the smooth, arched sealing surface always hits in the center on sealing ring 30.

The lidded barrel according to the invention is further distinguished in that the maximum outside diameter of barrel lid 12 is equal in size to the outside diameter of flange edge 40 that projects radially outward (both connect flush to one another), and the distance between the face of the outer downward-facing leg and the downward-opening U-shaped lid edge for the upward-facing lateral face of flange edge 40 that projects radially outward at the barrel opening edge with a lid put on and with the tension ring closure closed is only about 1 mm. For this purpose, it is ensured that when the stack load is applied, lid seal 30 needs to give only by this 1 mm, and then the outer leg of the lid edge will come into contact with flange edge 40 that projects outside and will be supported on it in such a way that overstressing of seal 30 will be avoided.

Figure 8:
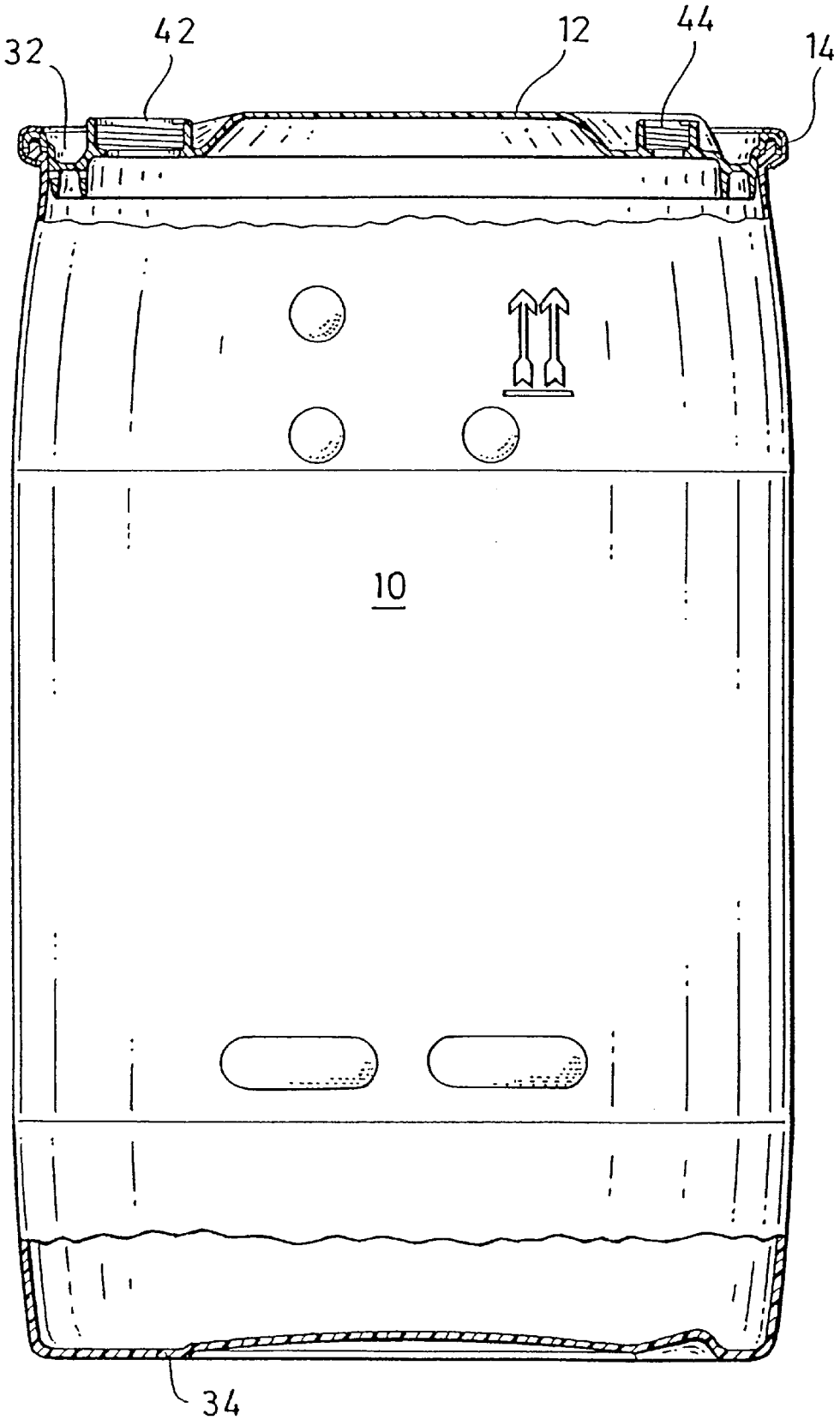
FIG. 8 shows another lidded barrel (without base ring) according to the invention in side view with a partial sectional view (European version)

Another lidded barrel according to the invention (European version) without a base ring and with a capacity of 220 liters is depicted in FIG. 8, which with barrel lid 12 put on and tension ring closure 14 in place has a barrel weight of only about 8 kg. The plastic of the barrel body consists of high-molecular-weight polyethylene (HD-PE). In this embodiment the disk-shaped upper plate of barrel lid 12 projects over U-shaped lid edge 16 which is open downward or the upper leg of tension ring 14 that engages over the latter. The excess height is about two to five times the wall thickness or thickness of the barrel lid, preferably about 10 mm. This is used to improve long-term stacking properties owing to a defined inner pressure buildup. In a modified embodiment, the lidded barrel can be equipped at the bottom with a base ring or bottom roller cage, which then is aligned in a plane with the bottom or is flush with it.

Figure 9:
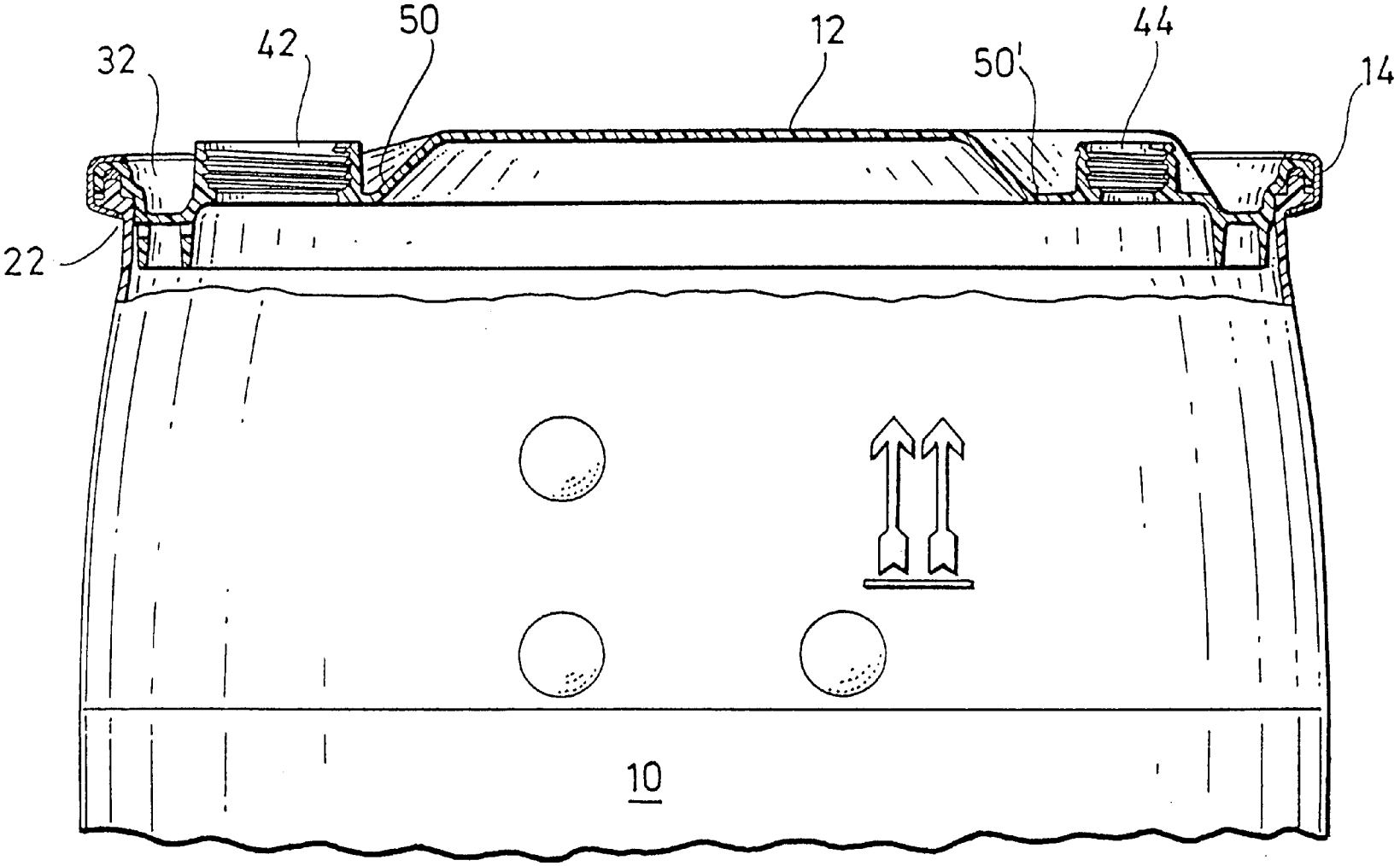
FIG. 9 shows an enlarged view of the upper barrel area of the lidded barrel according to FIG. 8.

FIG. 9 provides a better view of barrel lid 12 with two lateral bungs 42, 44 that are recessed in bung cavities 50, 50'. (Left) 2-inch bung 42 is provided for filling as well as for the removal of the contents by means of a suction pipe. Further, said bung 42 is designed as a residue-drain bung owing to the adjacent incline of the lid upper plate. Smaller ¾ inch bung 44 can be opened to vent the barrel during filling or removal processes.

As an additional, quite essential feature, it can be seen here that below V-shaped engaging groove 32 on the inside of barrel lid 12, two peripheral ring lands 54, 56, which are spaced a certain distance apart, are made. Outer ring land 54 rests on the inner barrel wall. Ring lands 54, 56 are spaced approximately 10 mm to 30 mm, preferably about 20 mm, apart and extend over a length of about 20 mm into the barrel in the axial direction. The particular feature of this embodiment variant of a lidded barrel now consists in the fact that it is has almost exactly the same dimensions as a suitably closed L-ring bung barrel, which is usual and in use at present in the chemical industry in Europe, so that the novel lidded barrel can be handled on pallets together with ordinary bung barrels and can be manipulated and handled with the same barrel-gripping tools as ordinary bung barrels. The novel lidded barrels in a light design can further be produced economically and later cause no disposal problems whatsoever since they are completely recyclable. Also, here, tension ring 14 can be an ordinary sheet-steel closure ring, but it can also be made entirely of plastic.

Figure 10:
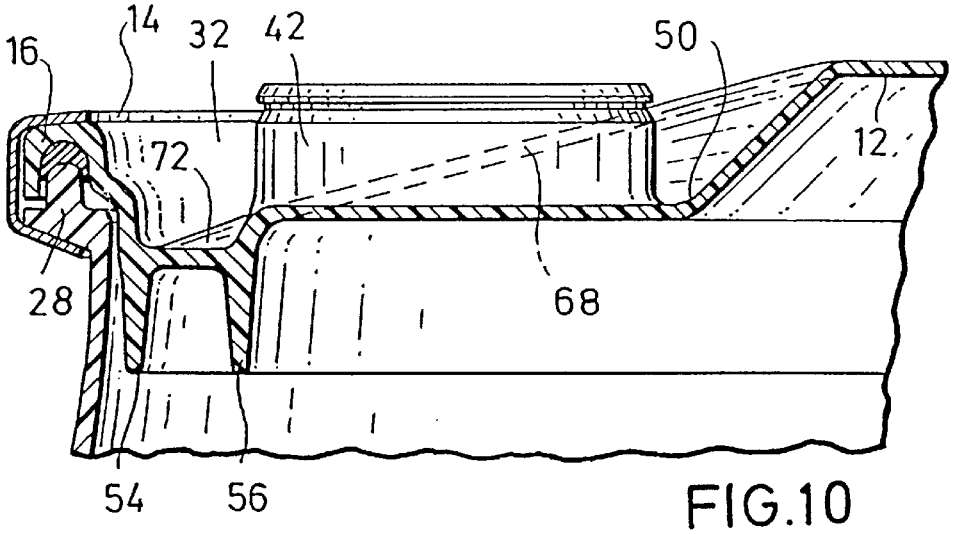
FIG. 10 shows an upper left barrel area in a partial sectional view.

In FIG. 10, barrel lid 12 is shown in a sectional view next to 2-inch bung 42. On both sides of bung housing 50, the upper plate of barrel lid 12 is designed tilted downward toward the lid edge. On the outside, incline 68 extends as far as the projection or the beginning of inner ring land 56 or as far as the inner flat edge of engaging groove 32.

Thus, when the lidded barrel is tilted slightly when inverted (turned over), the very last drop of liquid will flow out to lowest point 78 at the upper edge of inner ring land 56 or at the outer edge of the 2-inch bung or will run out through the bunghole from the inside of the barrel.

In order also to make it possible for residual liquid to flow out from the outer lid area or from the space between two ring lands 54 and 56, it is provided according to the invention that a bore 76 (or a wider crosswise opening) be introduced at least in inner ring land 56 directly in front of discharge bung 42. It is also advantageous to provide a suitable bore in outer ring land 54 at the same spot to make it possible for residual liquid from the space between the inside barrel wall and outside ring land 54. It is advisable to provide an inside-type indentation 74, viewed from the inside, directly in front of bung 42, into which bore 76, which is in ring land 56 and which leads to the bunghole, empties. In engaging groove 32, this inner outlet trough appears as a projection 72 that extends upward like a ridge obliquely to the bung.

Figure 11:
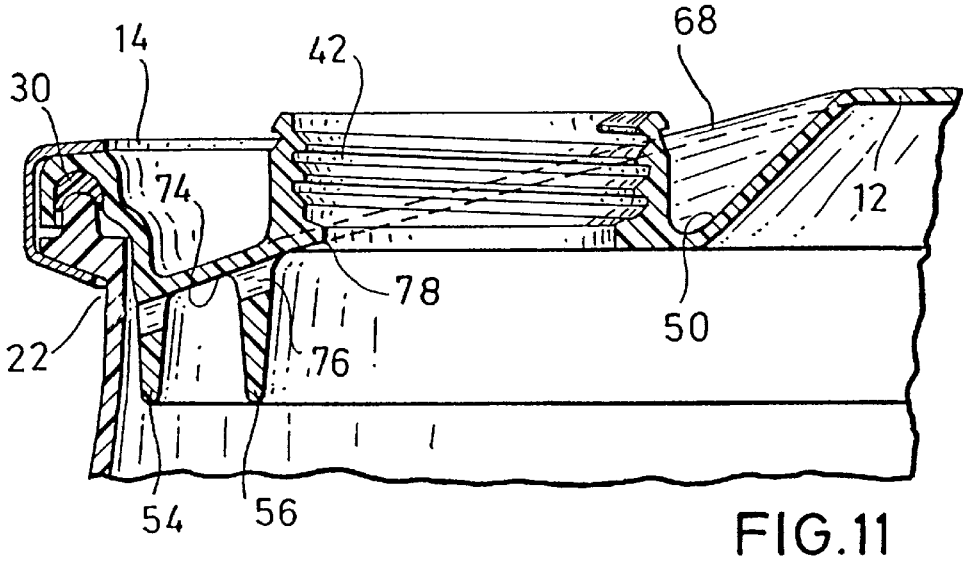
FIG. 11 shows the upper left barrel area according to FIG. 10 in a complete sectional view.

As FIG. 11 shows, bores 76 run through ring lands 54 and 56 obliquely to the bung and with a steeper inclination to the bung than incline 68, so that lowest point 78 is produced on the outer edge of the bunghole. This can be achieved so easily because flat groove floor 48 of engaging groove 32 is deeper than the bottom of bung housing 50. Groove floor 48 is approximately one to two wall thicknesses (about 30 mm to 10 mm) of the barrel lid deeper than the bottom of the bung housing.

Figure 12:
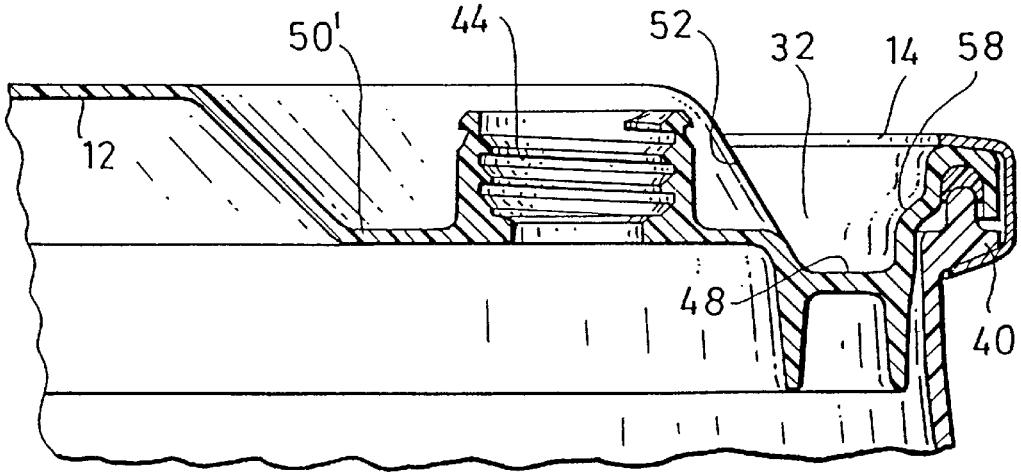
FIG. 12 shows an upper right barrel area in a sectional view.

In FIG. 12, the right edge area of a lidded barrel according to the invention is further shown in cross-section. As the other drawing figures also show, lid seal 30 is introduced into U-shaped lid edge 16 that is open downward. Engaging groove 32, which is about 20 mm to 40 mm deep, is placed between lid edge 16 and the central flat lid disk, which is designed to be higher. Engaging groove 32 has flat groove floor 48, which extends horizontally about 15 mm radially inward. From groove floor 48, obliquely conical ring part 52 rises (except in the bung housing area) as a connecting piece to the upper flat lid disk.

On the lower side of barrel lid 12, two ring flanges 54, 56, which are recessed about 20 mm (axially) in the barrel body, are made in the outside area. Also visible is the ¾-inch bung 44 arranged in recessed bung housing 50'. Basically, the residue-drain lid incline could also be placed here.

Figure 13:
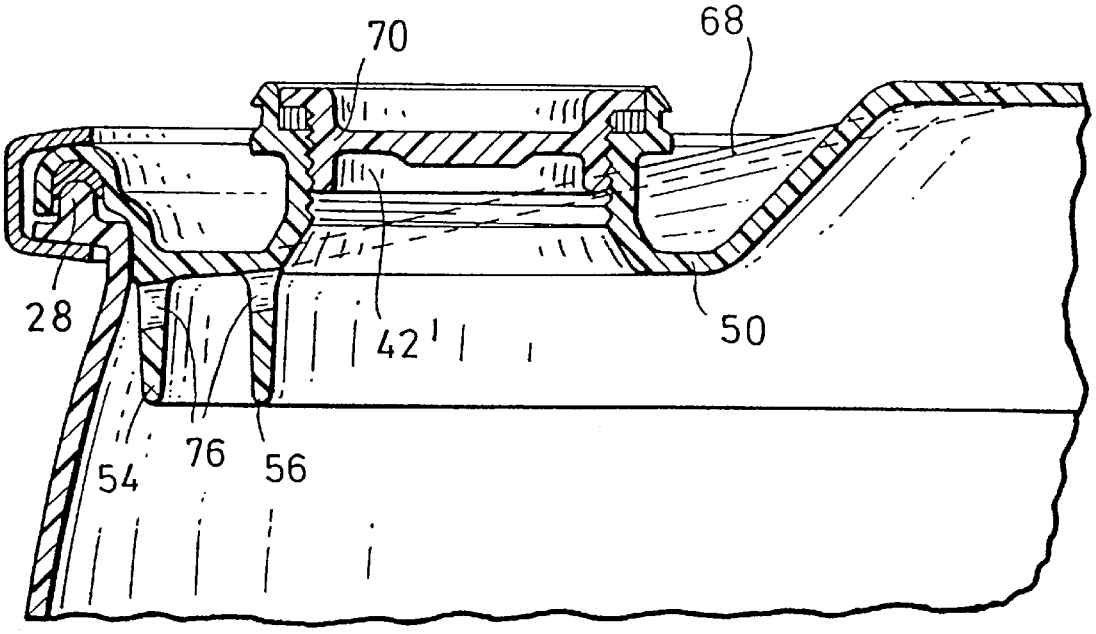
FIG. 13 shows an upper left barrel area in a sectional view of another embodiment (US version) and FIG. 14 shows an upper left barrel area in a sectional view of another embodiment (US version).

In FIG. 13, another embodiment of a lidded barrel according to the invention (US version) is presented. In this connection, discharge bung 42' in the embodiment usually found in the USA is designed with bung plug 70 which seals at the top at the bung connection piece—in contrast to the embodiment of the bung plug usually found in Europe, which comes to rest with its sealing ring and is sealed in the bung connection piece below the screw threading at a retracted conical sealing surface.

Figure 14:
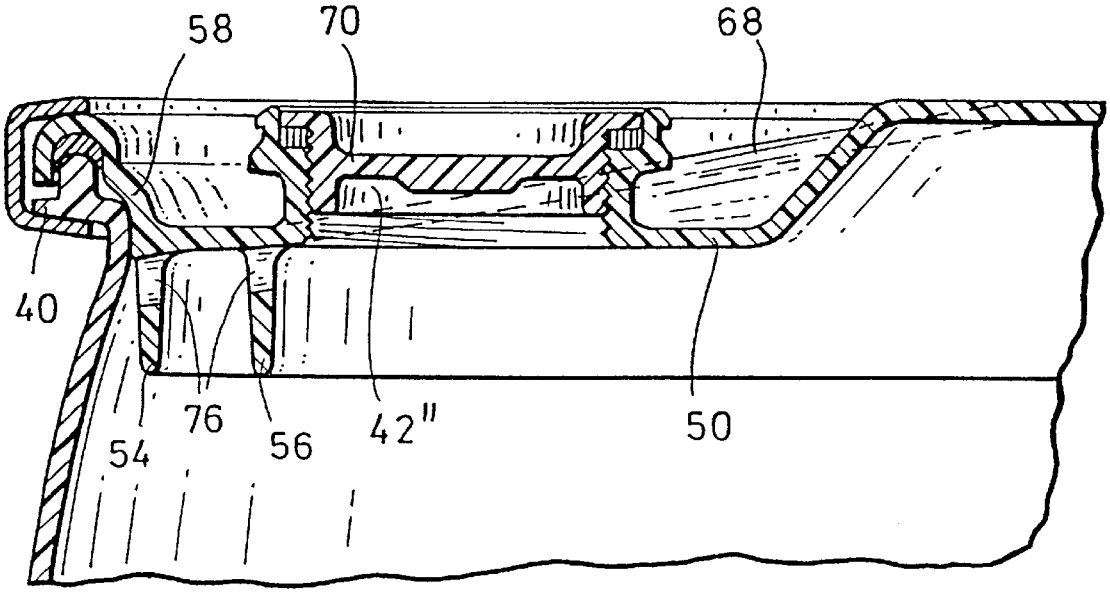

The last embodiment, depicted in FIG. 14 is distinguished from the embodiment shown in FIG. 13 essentially in that the upper plate or central flat lid disk 80 of the barrel lid is designed flush with the lid edge or flush with the upper leg of the tension ring. In this case, consequently, incline 68 of the flattened lid area runs correspondingly flatter laterally beside the discharge bung.

For the light barrel design according to the invention, it is necessary that, in particular, the barrel lid and the barrel opening area be matched exactly to one another. The special design of upper barrel edge 28 is significant. Part of this is that, to ensure secure attachment of lower barrel-gripping claw 66, the radial depth of indentation 22—measured from the extension line of the fully cylindrical part of the barrel body—is between 12 mm and 25 mm, preferably about 17 mm. The width of the slightly oblique attachment surface for the lower leg of tension ring 14 or the attachment surface for barrel-gripping claw 66 is also increased by virtue of the fact that solid barrel opening edge 28 is produced during the blow-molding process by squeezing the thermoplastically deformable plastic of the barrel wall with the aid of a mold slide in such a way that a small peripheral flange edge 40 that extends radially outward about 5 mm is formed on the outside down at barrel edge 28.

Barrel mouth edge 28 is designed as an inverted "L," which forms an angle of about 70° to 85°, preferably about 76°, between its long leg (=barrel wall) that points downward and its basically horizontal short leg that points outward. The short leg that points outward is designed to be slightly obliquely conical on its lower side, i.e., it tapers outward. The oblique surface is used as attachment surface for the lower leg of the tension ring which, with the lid seal in the closed state, presses the lid on the upper barrel wall by means of the oblique attachment surface. The short "L"-leg is provided on its upper side with a bead-like projection, which has a smooth semicircular sealing surface above. This beadlike projection engages in the U-shaped lid edge and seals against the lid seal. The outer edge of the U-shaped lid edge that points downward ends almost flush with flange edge 40 of barrel opening edge 28 that points radially outward, so that the lid seal will not be overstressed even in the case of overstacking.

The semicircular area of solid barrel opening edge 28 that points upward has a height of at least 10 mm and forms the sealing surface for lid seal 30. A special design of the mold slide in the blow mold ensures that the sealing surface of squeezed solid barrel mouth edge 28 that points upward remains free of folds and seams of the squeezed plastic.

To achieve the advantageous properties of the lidded barrel according to the invention, considerable numbers of details and subtleties that are matched to one another are important, which in combination with one another constitute the essence of this lidded barrel.

I claim:

1. A blow-molded lidded barrel (10) having a barrel body (20) with a bottom (34) and an upper open end defined by an upper barrel edge (28), having an uppermost surface, and a central cylindrical portion (26), a barrel lid (12) covering the open end of the barrel in a closed position of the lid, said barrel lid having a central section and an outer lid edge (16) which in cross-section defines a downwardly facing U-shaped part, a U-shaped tension-ring closure member (14), which in said closed position of the lid, engages with an upper leg of the ring over said outside lid edge (16) and engages with a lower leg of the ring under an outer radially extending barrel edge (18) disposed below the open end of the barrel body (20), characterized in that:

a) the lower leg of the tension-ring closure member (14) engages in an indentation (22) in the barrel body;

b) said indentation (22) has an upper boundary defined by said barrel edge (18) and a conical portion, which as measured in a direction toward a transition zone (24) to the said cylindrical portion (26) of the barrel wall, is increasingly conically flat in shape;

c) said transition zone (24) is located at a distance of 80 mm to 140 mm, from the upper barrel edge (28) of the barrel body (20);

d) the upper barrel edge (28) is solid, defines an outer support for a lid seal (30) and has a thickness of approximately double the thickness of barrel body (20); and e) said barrel lid (12) between said outer lid edge (16) and said central section has an annular circumferential engaging groove (32) with a radially extending groove floor (48) having inner and outer radial edges, said groove floor being disposed in said barrel body (20) at a level below said central section of said lid when said lid is in said closed position.

2. Lidded barrel according to claim 1, wherein:

a) said engaging groove is defined in part by an inner side wall (52) which slopes obliquely upwardly from said groove floor to said central section of the lid; and b) said central section includes at least one bung (42, 44).

3. Lidded barrel according to claim 2, wherein:

a) said conical portion of the barrel inside indentation (22) at said transition zone (24) is disposed at an acute angle of between about 15° and 30° to said cylindrical portion (26) of barrel body (20).

4. Lidded barrel according to claim 2, wherein:

a) the radial depth of said indentation (22), measured from an extension line of said cylindrical portion (26) of barrel body (20), is between about 12 mm and 25 mm.

5. Lidded barrel according to claim 2, wherein:

a) said barrel edge (18) is spaced a distance of between about 10 mm to 20 mm below the uppermost surface of the upper barrel edge (28).

6. Lidded barrel according to claim 2, wherein:

a) a lid seal 30 is disposed within the U-shaped part of said outer lid edge; and b) an area of said barrel edge (28) points upwardly and has a smooth, partially circular cross-section defining said uppermost surface for sealingly engaging with said lid seal (30).

7. Lidded barrel according to claim 2, wherein:

a) said barrel edge (28), as produced during the blow-molding process by squeezing the thermoplastically deformable plastic of the barrel wall by means of a mold slide, includes a peripherally extending small flange edge (40) with a radially outwardly directed extension of between about 3 and 5 mm outside on the barrel edge (28), said extension defining, in part, said barrel edge (18).

8. Lidded barrel according to claim 2, wherein:

a) said barrel body (20) has a peripheral bottom roller ring (36) in a bottom transition area extending from the cylindrical portion (26) of the barrel wall to the barrel bottom (34), said bottom roller ring (36) having an outside diameter that is substantially equal to that of said tension ring member (14).

9. Lidded barrel according to claim 2, wherein:

a) said barrel has a height/diameter ratio of about 1.57 with said barrel lid (12) and tension-ring closure member (14) in said closed position, for a capacity of about 30 US gallons.

10. Lidded barrel according to claim 2, wherein:

a) said barrel has a height/diameter ratio of about 1.82 with said barrel lid (12) and tension-ring closure member (14) in said closed position for a capacity of about 35 US gallons.

11. Lidded barrel according to claim 2, wherein:

a) said barrel has a height/diameter ratio of about 1.06 with said barrel lid (12) and tension-ring closure member (14) in said closed position, for a capacity of about 36 U.S. gallons.

12. Lidded barrel according to claim 2, wherein:

a) said barrel has a height/diameter ratio of about 1.49 with said barrel lid (12) and tension-ring closure member (14) in said closed position, for a capacity of about 52.5 U.S. gallons.

13. Lidded barrel according to claim 2, wherein:

a) said barrel has a height/diameter ratio of about 1.55 with said barrel lid (12) and tension-ring closure member (14) in said closed position, for a capacity of about 55 U.S. gallons.

14. Lidded barrel according to any one of claims 9–13, wherein:

a) said cylindrical portion (26) of the barrel body includes at least one barrel body roller ring (38);

b) said barrel body (20) has a peripheral bottom roller ring (36);

c) all diameter measurements for the barrel are the same; and d) the maximum barrel diameter of the barrel body roller ring (38), the tension-ring closure member (14) and the bottom roller ring (36) is about 474 mm.

15. Lidded barrel according to claim 2, wherein:

a) said cylindrical portion (26) is at least three-fourths the height of the barrel body (20).

16. Lidded barrel according to claim 2, wherein:

a) said barrel body (20) has a peripheral bottom roller ring (36) at the bottom (34) of the barrel;

b) said barrel body (20) includes a lower indentation immediately above said bottom roller ring (36);

c) said barrel body (20) includes a transition area extending from the cylindrical portion (26) of the barrel wall to said lower indentation, said transition area extending at an acute angle of between about 15° and 30° to the cylindrical portion (26).

17. Lidded barrel according to claim 2, wherein:

a) said bung (42) is located in a recessed bung housing (50) in the central section of said barrel lid, said housing (50) having a bottom disposed above the groove floor (48); and an inclined section (68) extends downwardly from the central section at an inclined slope to the radial inner edge of groove floor.

18. Lidded barrel according to claim 2, wherein:

a) the lower side of said barrel lid (12) below said engaging groove (32) includes an outer and inner ring flange (54, 56), said flanges being spaced radially from one another by a distance of between about 10 mm and 30 mm, and having a length as measured axially of said barrel of between about 10 mm and 30 mm.

19. Lidded barrel according to claim 18, wherein:

a) at least said inner ring flange (56) includes a bore (76) located directly radially outwardly of said bung (42).

20. Lidded barrel according to claim 19, wherein:

a) bores (76) run through each of said flanges (54, 56) at an incline equal to the inclined slope of said inclined section (68) so that the lowest point (78), when the barrel is inverted, is located on the radial outer edge of the bung (42).

21. Lidded barrel according to claim 18, wherein:

a) the engaging groove (32) includes a radial groovelike indentation (74), viewed from the inside of said lid, directly radially in front of bung (42), for defining a drainage canal, in which said bore (76) in said inner flange (56) is disposed.

22. A lidded barrel according to claim 18, wherein:

a) the engaging groove (32) is connected to said lid edge (16) by a connecting wall (58) which defines an inclined stepped surface for engagement with an inside wall portion of the barrel body (20) in said closed position of said lid.

23. In an open top barrel (10) having a barrel body (20) with an upper end defined by an upper barrel edge (28) extending circumferentially around said barrel and including a horizontal first portion (27) extending radially away from said body (20) and having a downwardly facing surface (18), and a vertical second portion (29) extending upwardly from said first portion (27) at a location radially outwardly of said body (20), the improvement comprising:

a) an exterior rib (40), said rib (40) defining part of said barrel edge and having both an upper surface and a lower surface projecting radially outwardly of said first and second portions with said lower surface of said rib disposed along said predetermined plane and defining a part of said downwardly facing surface (18), said rib (40) terminating in a free end surface connecting said upper and lower surfaces.

24. The open top barrel according to claim 23 wherein:

a) said rib (40) extends radially outwardly from said first and second portions (27, 29) by a distance between about 3 and 5 mm.

25. An open top barrel comprising:

a bottom;

a sidewall; and an upper open top defined by an upper barrel edge (28), said upper barrel edge including:

a first wall (27) extending substantially radially outwardly from said sidewall, a second wall (29) extending upwardly from an outer portion of said first wall at a location radially outwardly of said sidewall and having a lower portion (31) adjacent said first wall (27), and an exterior circumferential rib (40) circumscribing said lower portion (31) of said second wall (29), said rib having both an upper surface and a lower surface projecting radially outwardly of said first wall and said second wall and terminating in a free end surface connecting said upper and lower surfaces.

26. The barrel according to claim 25, wherein:

a) the barrel is constructed of molded plastic material; and b) said second wall of said upper barrel edge (28) is solid and free of any folds and seams of plastic material which may occur during the molding of the barrel.

27. The barrel according to claim 26, wherein:

a) any folds or seams of plastic material that may occur during the molding of the barrel are located in said exterior circumferential rib (40).

28. In a blow-molded lidded barrel (10) having a barrel body (20) with an upper open end defined by an upper barrel edge (28) having a horizontal first portion (27) extending radially away from said body (20) and having a downwardly facing surface (18) disposed along a predetermined plane, and a vertical second portion (29) extending upwardly from said first portion (27) at a location radially outwardly of said body (20), to define an uppermost surface, a barrel lid (12) covering the open end of the barrel in a closed position of the lid, said lid having a central section and an outer peripheral lid edge (16) which in cross-section defines a downwardly facing U-shaped part overlying said upper barrel edge (28), a U-shaped tension-ring closure member (14), which in said closed position of the lid engages with an upper leg of said-tension ring closure member over an upwardly facing surface of said outer lid edge (16) and engages with a lower leg of said tension-ring closure member under said outer downwardly facing surface (18) that extends below said uppermost surface of the upper barrel edge (28), the improvement comprising:

a) an exterior rib (40), said rib (40) defining part of said barrel edge and having both an upper surface and a lower surface projecting radially outwardly of said first and second portions with said lower surface of said rib disposed along said predetermined plane and defining a part of said downwardly facing surface (18), said rib (40) terminating in a free end surface connecting said upper and lower surfaces.

* * * * *